United States Patent [19]

Binet et al.

[11] 4,357,184

[45] Nov. 2, 1982

[54] EXPLOSIVE COMPOSITIONS BASED ON TIME-STABLE COLLOIDAL DISPERSIONS

[75] Inventors: Rejean Binet, St. Bruno; Joseph A. R. Cloutier, Montreal; Anthony C. F. Edmonds; Harold W. Holden, both of St. Hilaire; Melvin A. McNicol, Otterburn Park, all of Canada

[73] Assignee: C-I-L Inc., North York, Canada

[21] Appl. No.: 210,300

[22] Filed: Nov. 25, 1980

Related U.S. Application Data

[63] Continuation-in-part of Ser. No. 129,279, Mar. 10, 1980, abandoned.

[30] Foreign Application Priority Data

Apr. 2, 1979 [CA] Canada ..... 324627
Dec. 14, 1979 [CA] Canada ..... 342098

[51] Int. Cl.[3] ..... C06B 45/00

[52] U.S. Cl. ..... 149/2; 149/21; 149/41; 149/46; 149/60; 149/61; 149/87

[58] Field of Search ..... 149/2, 21, 41, 46, 60, 149/61, 87

[56] References Cited

U.S. PATENT DOCUMENTS 4,218,272 8/1980 Brockington ..... 149/2 X
4,231,821 11/1980 Sudweeks et al. ..... 149/2 X
4,248,644 2/1981 Healy ..... 149/2 X

*Primary Examiner*—Stephen J. Lechert, Jr.
*Attorney, Agent, or Firm*—Donald G. Ballantyne

[57] ABSTRACT

A water-in-oil explosive composition based on colloidal dispersions is provided. Unlike conventional emulsion explosive compositions, the microemulsion composition of the invention displays exceptional long term storage stability retaining sensitivity to propagation even in small diameter charges. The composition is also tolerant to doping with further fuel and energy enhancing ingredients. The microemulsion-producing component of the composition comprises a combination of at least one conventional water-in-oil emulsifier and at least one amphiphatic synthetic polymeric emulsifier selected from graft, block or branch polymers.

48 Claims, No Drawings

EXPLOSIVE COMPOSITIONS BASED ON TIME-STABLE COLLOIDAL DISPERSIONS

This application is a continuation-in-part application of the U.S. patent application Ser. No. 129,279 filed on Mar. 10, 1980; now abandoned.

This invention relates to waterproof explosive compositions based on ultra-stable colloidal dispersions. More particularly, this invention relates to explosive compositions comprising, in part or in whole, a water-in-oil microemulsion which results from the use of blends of specific emulsifiers and co-surfactants.

Conventional low cost commercial explosives rely on ammonium nitrate as the primary source of energy for blasting. Ammonium nitrate/fuel oil compositions (ANFO) and thickened water-based ammonium nitrate-containing explosives (slurries) are widely used blasting compositions. However, these compositions may not produce optimum results under conditions frequently encountered in the field nor are these compositions always acceptable from other standpoints. The use of ANFO, for example, is generally restricted to fairly dry boreholes. Also, ANFO does not perform well in blasting hard rock because of its low brisance and low bulk energy. The development of the pumpable water-based slurries has overcome some of the problems, but the need to incorporate special thickening and cross-linking agents in the slurries increase their cost. Also, for these slurry compositions to perform well, especially in small diameter charges, their density and hence their bulk energy must be appreciably lowered if the incorporation of large amounts of self-explosive sensitizing agents is to be avoided.

The discovery of water-in-oil emulsion explosives in which the oil/fuel phase is external or continuous and the oxidizer salt phase comprising dispersed small supersaturated droplets is discontinuous, has resulted in a pumpable, fluid explosive which in many instances displays improved performance over the water-based slurries. This improvement results principally because the surface area of contact between the oxidizer phase and the fuel phase is increased. This enhanced intimacy produces a more sensitive and faster reacting mixture and provides a high brisance explosive.

Water-in-oil emulsion explosives are now well known in the explosives art. Bluhm, in U.S. Pat. No. 3,447,978 discloses a composition comprising an aqueous discontinuous phase containing dissolved oxygen-supplying salts, a carbonaceuous fuel continuous phase, an occluded gas and a water-in-oil emulsifier. Cattermole et al., in U.S. Pat. No. 3,674,578 describe a similar composition containing as part of the inorganic oxidizer phase, a nitrogen-base salt such as an amine nitrate. Tomic, in U.S. Pat. No. 3,770,522 also describes a similar composition wherein the emulsifier is an alkali or ammonium stearate. Wade, in U.S. Pat. No. 3,715,247 describes a small-diameter cap-sensitive emulsion type explosive composition comprising carbonaceous fuel, water, inorganic salts, an emulsifier, gas bubbles, and a detonation catalyst consisting of a water-soluble salt containing selected metals. In U.S. Pat. No. 3,765,964, Wade describes an improvement in the composition of U.S. Pat. No. 3,715,247 by including therein a water-soluble strontium compound to provide further sensitivity. Wade again, in U.S. Pat. No. 4,110,134 describes an emulsion type explosive composition devoid of any self explosive ingredient and containing a closed-cell void-containing material as a density controller. Wade further describes, in U.S. Pat. No. 4,149,916, a cap sensitive emulsion type explosive composition containing perchlorates and occluded air and in U.S. Pat. No. 4,149,917 he describes a similar composition without any sensitizer other than occluded air. Sudweeks and Jessop in U.S. Pat. No. 4,141,767 describe a cap-insensitive water-in-oil emulsion explosive composition containing a fatty acid amine or ammonium salt emulsifier having a chain length ranging from 14 to 22 carbon atoms. In applicant's copending Canadian application Ser. No. 317,649, filed on Dec. 8, 1978, there is described a sensitive emulsion type explosive composition containing fuel, water, salts, gas bubbles, an emulsifier and an emulsification promoter comprising a highly chlorinated paraffinic hydrocarbon. Clay, in U.S. Pat. No. 4,111,727 describes a blasting composition consisting of a greasy, water-in-oil emulsion admixed with a substantially undissolved particulate solid oxidizer salt constituent so as to fill the interstices between salt particles to increase the bulk density of the mass. Similar blasting compositions had also been disclosed by Egly and Neckar in U.S. Pat. No. 3,161,551 and by Butterworth in South African patent specification No. 71/3355. Mullay, in U.S. Pat. No. 4,104,092 describes an aqueous gel explosive composition wherein a water-in-oil emulsion is uniformly distributed in the gel portion.

While all of the aforementioned emulsion compositions are meritorious, they are not without some disadvantages. The composition of Bluhm, for example, is only suitable for use in large diameter charges and requires strong primer initiation. The compositions of Cattermole et al. while useful in small diameter charges, require the use of expensive raw materials, demand extra handling precautions because of the sensitive nature of some of the ingredients used and hence lead to increase costs.

The compositions of Wade, and other prior art water-in-oil emulsion-based explosives exhibit limited stability. These compositions quickly tend to become dry and hard upon aging which condition deleteriously affects their handling characteristics and their explosive performance. The emulsifying agents used heretofore have not been sufficiently effective in permanently suppressing the coalescence of the supersaturated oxidizer salt droplets. Fairly large quantities of perchlorate salts or other sensitizing agents must be incorporated in the mixtures in order to retain cap-sensitivity at densities above 1.10 g/cc for any appreciable period of time. The compositions of Clay are substantially similar to and behave like ANFO and can not be expected to offer much improved water resistance. Furthermore, any of the composition containing added excess salts would exhibit very limited stability because of the seeding or precipitation effect of the salt crystals leading to a fairly rapid breakdown of the emulsion.

Thus, there remains a need in the explosives art for a low cost, high velocity and relatively high density explosive which is easy to manufacture, pumpable, water resistant and more importantly, which is safe to handle, stable over long periods of storage and sufficiently sensitive to propagate in very small diameter boreholes. The present invention provides an improved water-in-oil emulsion explosive composition which meets all the above-mentioned objectives.

The effectiveness of emulsification of the aqueous salts and liquid fuels as a promoter of explosive performance is crucially dependent on the activity of the emulsifying agent chosen. The emulsifying agent aids the process of droplets subdivision and dispersion in the continuous phase by reducing the surface tension and the energy required to create new surfaces. The emulsification agent also reduces the rate of coalescence by coating the surface of the droplets with a molecular layer of the emulsifying agent. The emulsifiers employed in the aforementioned prior art explosive compositions are somewhat effective in performing these functions but they are limited in their utility because the droplet surfaces still contain energy and coalescence of the droplets and breakdown of the emulsion takes place over time.

The emulsifier systems of the present invention are of a novel and distinct class of materials which function to produce a water-in-oil microemulsion. In the context of the present invention, the term 'microemulsion is intended to denote a liqui-liquid foam of very small cell size ranging normally from less than 1 micron to about 15 microns. These microemulsions demonstrate a surprising stability and retention of initiation sensitivity, and they possess extreme intimacy of mixing which is achievable under a variety of mixing conditions. The novel emulsifier systems of this invention provide means whereby water-in-oil microemulsions may be formed with concentrated oxidizer salt(s) common in explosive formulations.

The water-in-oil microemulsion explosive compositions of the invention comprise essentially an aqueous solution of at least one oxygen-supplying salt as a discontinuous phase, an insoluble liquid or liquefiable carbonaceous fuel as a continuous phase, at least one sensitizing component distributed substantially homogeneously throughout the composition as a further discontinuous phase and a distinct definable blend of emulsifying agents capable of producing a time-stable microemulsion. The compositions may optionally contain particulate oxygen-supplying salts, ANFO, particulate light metals, particulate fuels, particulate solid explosives, soluble and partly soluble self-explosives, explosive oils and the like for purposes of augmenting the strength and sensitivity or decreasing the cost of the compositions. The specific blends of emulsifiers capable of producing a time-stable, water-in-oil microemulsion explosive composition comprise a mixture of at least one amphiphatic synthetic polymeric emulsifier selected from graft, block or branch polymers and at least one conventional water-in-oil emulsifier. Optionally a phosphatide emulsion stabilizer may be included in the blend. By "amphiphatic graft, block or branch polymers" is meant a polymer comprising at least two or more segments, one of which is only soluble in an oil phase and the other only soluble in an aqueous phase, each segment having a molecular weight of at least 500. By "conventional water-in-oil emulsifier" is meant herein the relatively low molecular weight emulsifiers which are capable of producing a water-in-oil emulsion. Most of these emulsifiers are listed in the well known publication "McCutcheon's Detergents & Emulsifiers".

Exemplary of the synthetic polymeric emulsifiers used in the combinations are:

A. Copolymers of the general formula $(A\text{-}COO)_m\text{-}B$ wherein m is 2, wherein each polymeric component A has a molecular weight of at least 500 and is the residue of an oil-soluble complex monocarboxylic acid having the general structural formula:

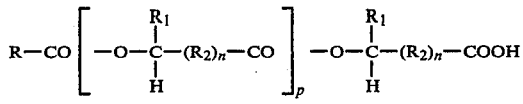

(I)

in which

R is hydrogen or a monovalent hydrocabon or substituted hydrocarbon group;

$R_1$ is hydrogen or a monovalent $C_1$ to $C_{24}$ hydrocarbon group;

$R_2$ is a divalent $C_1$ to $C_{24}$ hydrocarbon group;

n is zero or 1;

p is an integer from zero up to 200;

and wherein each polymeric component B has a molecular weight of at least 500 and is the divalent residue of a water-soluble polyalkylene glycol having the general formula:

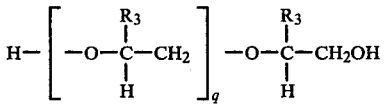

(II)

in which $R_3$ is hydrogen or $C_1$ to $C_3$ alkyl group;

q is an integer from 10 up to 500.

The units of the formula

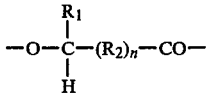

which are present in the molecule of the complex monocarboxylic acid as represented by Formula I may all be the same or they may be different in respect of $R_1$, $R_2$ and n. Similarly, the units of the formula

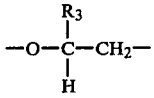

which are present in the polyalkylene glycol as represented by Formula II may all be the same or they may be different in respect of $R_3$.

The complex monocarboxylic acid, from which the polymeric components A are derived by the notional removal of the carboxyl group, is structurally the product of interesterification of one or more monohydroxymonocarboxylic acids together with a monocarboxylic acid free from hydroxyl groups which acts as a chain terminator. The hydrocarbon chains R, $R_1$ and $R_2$ may be linear or branched. R is preferably an alkyl group containing up to 25 carbon atoms, for example a straight-chain $C_{17}H_{35}$-group derived from stearic acid. $R_1$ is preferably a straight-chain alkyl group, and $R_2$ is preferably a straight-chain alkylene group; for example, the unit containing $R_1$ and $R_2$ may be derived from 12-hydroxystearic acid.

The polyalkylene glycol of the Formula II, from which the polymeric component B is derived by the notional removal of the two terminal hydroxyl groups, may be, for example, a polyethylene glycol, a polypropylene glycol, a mixed poly (ethylene-propylene) glycol or a mixed poly(ethylene-butylene) glycol, but preferably a polyethylene glycol.

Preferably each of the polymeric components A has a molecular weight of at least 1000 (by "molecular weight" is meant number average molecular weight). Thus where, for example, the group R is derived from stearic acid and the unit containing $R_1$ and $R_2$ together is derived from 12-hydroxystearic, p will have a value of at least 2. Similarly, it is preferred that the polymeric component B has a molecular weight of at least 1000. Thus where that component is the residue of a polyalkylene glycol which is derived from ethylene oxide exclusively, q will preferably have a value of at least 23.

For optimum results for purposes of the present invention the proportion of polymeric component B in the copolymer is between about 20% to 50%, preferably 25% to 35% by weight of the total copolymer.

B. Polyesters obtained by the condensation of (i) an alk(en)yl succinic anhydride of the formula

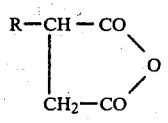

where R is a saturated or unsaturated hydrocarbon substituent derived from a polymer of a mono-olefin, the said polymer comprising a chain containing from 40–500 carbon atoms, and (ii) a polyalkylene glycol which has a molecular weight of 500 to 20,000. The polyester so obtained contains 10% to 80%, preferably 20% to 60%, by weight of residues of the polyalkylene glycol (ii).

The alk(en)yl succinic anhydrides which are used in making the polyester are known commercial materials. For making the anhydrides (i), suitable polyolefins include those obtained by polymerising a mono-olefin containing from 2 to 6 carbon atoms, for example ethylene, propylene, butylene, isobutylene and mixtures thereof, the derived polymers containing from 40 to 500 carbon atoms in the chain as stated heretofore.

A preferred alk(en)yl succinic anhydride is (polyisobutenyl) succinic anhydride containing from 50 to 200 carbon atoms in the alkenyl chain.

The alk(en)yl succinic anhydrides (i) may, however, if desired be a mixture of two or more different compounds which respectively satisfy the foregoing definitions. A minor proportion of a monobasic carboxylic acid may be included to adjust the functionality and/or degree of branching of the derived polyesters.

The polyalkylene glycols (ii) which are used in making the polyesters may be, for example, polyethylene glycols, mixed poly(ethylene-propylene) glycols or mixed poly(ethylene-butylene) glycols, provided that they satisfy the molecular weight requirement hereinbefore stated. The polyalkylene glycols are also commercially available materials, and a single such compound or a mixture of two or more such compounds differing in composition and/or molecular weight may be used in making the polyesters if desired.

Preferred polyalkylene glycols for use in making the polyesters are polyethylene glycols of average molecular weight 500 to 1,500.

In addition to the polyalkylene glycol(s), other polyols such as glycerol, trimethylol propane, pentaerythritol and sorbitol may be incorporated in order to adjust the overall functionality of the components and/or increase the degree of branching of the polymers.

C. Alkyd resins obtained by the condensation of a polybasic acid or anhydride, usually in combination with a monobasic acid, and a polyhydric alcohol.

The polybasic acid component of the alkyd resin may be saturated, or unsaturated either by olefinic or aromatic unsaturation. Commonly used acids are aliphatic or aromatic dibasic acids containing up to 20 carbon atoms, preferably up to 10 carbon atoms such as, for example, ortho-, iso- or terephthalic acid, maleic acid and fumaric acid. The polybasic acid may also be tri- or tetra-basic, suitably an aromatic acid containing up to 20, preferably up to 10 atoms such as, for example, trimellitic acid or pyromellitic acid.

The optional monobasic acid component of the alkyd resin, which functions as a monofunctional chain terminator, may be derived from a free acid or from an ester of the acid, particularly a glyceride. The acid is preferably an aliphatic saturated or ethylenically unsaturated acid containing up to 30 carbon atoms, preferably 6 to 22 carbon atoms. Mixtures of acids or their esters may also be used to derive the mono-basic acid component, particularly naturally-occurring mixtures such as tall oil acids, or acids derived from linseed oil, soybean oil, castor oil, cottonseed oil and the like. Other monobasic acid chain terminators known to those expert in the field may also be used as may monohydric alcohol chain terminators which are also known for this purpose, for example, $C_1$ to $C_{20}$ alkanols.

The polyhydric alcohol is a water-soluble polyalkylene glycol which has a molecular weight in the range of 500 to 10,000 preferably 500 to 5,000. The water-soluble polyalkylene glycol is preferably polyethylene glycol, but polypropylene glycol or polyalkylene glycols containing a major proportion of ethyleneoxy groups together with minor proportions of randomly distributed propyleneoxy and/or butyleneoxy groups may also be used. One of the terminal hydroxyl groups of the polyalkylene glycol may, if desired, be etherified, for example, with a lower $C_1$ to $C_6$ alcohol.

D. Copolymers as described in A but with the polyoxyethylene chain of the polyalkylene glycol moiety replaced by a polyethylene-imine chain (i.e. replacing the oxygen atom in the polyoxyethylene by a N-H group).

The substitution of the polyoxyethylene chain of the polyalkylene glycol of the block copolymers A by a polyethyleneimine chain does not significantly alter the emulsifying ability of these resins. The proportion of polymeric components in the block copolymer of these polyethylene-imine based polymers are as described in the types A. Also these polymers can be largely a salt or an amide depending on the conditions present during their synthesis.

Exemplary of the conventional water-in-oil emulsifiers with which the amphiphatic polymeric emulsifiers of the above-described types A, B, C and D are combined in order to produce the microemulsion explosive compositions of this invention are:

E. Those derived from sorbitol by esterification such as sorbitan fatty acid esters, for example, sorbitan monooleate, sorbitan sesquioleate, sorbitan monostearate and the like;

F. Mono and diglycerides of fat-forming fatty acids such as Atmos 300 (Reg. TM), Dur-Em 187 (Reg. TM), Dur-Em 207 (Reg. TM) and the like;

G. Polyoxyethylene sorbitol esters such as polyoxyethylene sorbitol beeswax derivative materials and the like;

H. Substituted imidazolines such as Witcamine PA-78B (Reg. TM) and the like;

I. Aliphatic amido-amines such as Witcamine 210 (Reg. TM) and the like;

J. Glycerol esters such as glycerol monooleate, glycerol monostearate, decaglycerol decaoleate and the like;

K. Fatty acid amines or ammonium salts such as Armac HT (Reg. TM) and the like;

L. Hydrocarbon sulphonate salts such as the petroleum sulphonates and more particularly sodium petroleum sulphonates and the like; and M. Alkali metal or ammonium stearates used alone or in combination with stearic acid.

It has been found that an optional phosphatide emulsion stabilizer in admixture with the polymeric emulsifier(s) and the conventional water-in-oil emulsifier(s) can be employed to yet further improve the long term stability and sensitivity of the emulsion. Particularly effective phosphatides are those having the structural formula

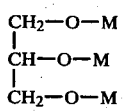

wherein M is selected from the class consisting of fatty acyl radicals and phosphorus-containing radicals having the structural grouping

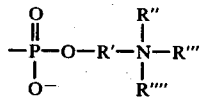

wherein R′ is a lower alkylene radical having from 1 to about 10 carbon atoms and R″, R‴ and R⁗ are lower alkyl radicals having from 1 to 4 carbon atoms and wherein at least one but no more than one of the M radicals comprise the phosphorus-containing radical. The fatty acyl radicals are for the most part those derived from fatty acids having from 8 to 30 carbon atoms in the fatty radicals such as, for example, palmitic acid, stearic acid, palmitoleic acid, oleic acid and linoleic acid. Especially desirable radicals are those derived from commercial fatty compounds such as soybean oil, cotton seed oil, castor seed oil and the like. A particularly effective phosphatide is soybean lecithin.

The ratio of polymeric emulsifier(s) to conventional water-in-oil emulsifier(s) is in the range of 1:25 to 3:1, but preferably in the range of 1:5 to 1:1. The total quantity of the mixed emulsifiers found suitable for use is from 0.4% to 4%, preferably from 0.6% to 1.6% by weight of the total microemulsion composition. The quantity of optional phosphatide stabilizer which can be used is from 0.05% to 5.0%, preferably from 0.5% to 1.5% of the total microemulsion composition. The ratio of mixed emulsifiers (polymeric plus conventional) to the phosphatide stabilizer can be in the range of 1:10 to 100:1 but preferably is in the range of 1:3 to 5:1.

The preferred inorganic oxygen-supplying salt suitable for use in the water-in-oil microemulsion composition is ammonium nitrate; however a portion of the ammonium nitrate may be replaced by other oxygen-supplying salts such as alkali or alkaline earth metal nitrates, chlorates, perchlorates or mixtures thereof. The quantity of oxygen-supplying salt used in the water-in-oil microemulsion may range from 30% to 90% by weight of the total composition.

Suitable water-immiscible emulsifiable fuels for use in the water-in-oil microemulsion include most hydrocarbons, for example, paraffinic, olefinic, naphthenic, elastomeric, aromatic, saturated or unsaturated hydrocarbons. Preferred among the water-immiscible emulsifiable fuels are the highly refined paraffinic hydrocarbons. The quantity of liquid or liquefiable carbonaceous fuel used in the water-in-oil microemulsion may comprise up to 20% by weight of the total composition.

The sensitizing component distributed substantially homogeneously throughout the composition is preferably occluded gas bubbles which may be introduced in the form of glass or resin microspheres or other gas-containing particulate materials. Alternatively, gas bubbles may be generated in-situ by adding to the composition and distributing therein a gas-generating material such as, for example, an aqueous solution of sodium nitrite. Other suitable sensitizing components which may be employed alone or in addition to the occluded or in-situ generated gas bubbles include insoluble particulate solid self-explosives such as, for example, grained or flaked TNT, DNT, RDX and the like and water soluble and/or hydrocarbon soluble organic sensitizers such as, for example, amine nitrates, alkanolamine nitrates, hydroxyalkyl nitrates, and the like. The explosive compositions of the present invention may be formulated for a wide range of applications. Any combination of sensitizing components may be selected in order to provide an explosive composition of virtually any desired density, weight-strength or critical diameter.

The quantity of solid self-explosive ingredients and of water-soluble and/or hydrocarbon-soluble organic sensitizers may comprise up to 40% by weight of the total composition. The volume of the occluded gas component may comprise up to 50% of the volume of the total explosive composition.

Optional additional materials may be incorporated in the composition of the invention in order to further improve sensitivity, density, strength, rheology and cost of the final explosive. Typical of materials found useful as optional additives include, for example, emulsion promotion agents such as highly chlorinated paraffinic hydrocarbons, particulate oxygen-supplying salts such as prilled ammonium nitrate, calcium nitrate, perchlorates, and the like, ammonium nitrate/fuel oil mixtures (ANFO), particulate metal fuels such as aluminium, silicon and the like, particulate non-metal fuels such as sulphur, gilsonite and the like, particulate inert materials such as sodium chloride, barium sulphate and the like, water phase or hydrocarbon phase thickeners such as guar gum, polyacrylamide, carboxymethyl or ethyl cellulose, biopolymers, starches, elastomeric materials, and the like, crosslinkers for the thickeners such as potassium pyroantimonate and the like, buffers or pH controllers such as sodium borate, zinc nitrate and the like, crystals habit modifiers such as alkyl naphthalene sodium sulphonate and the like, liquid phase extenders such as formamide, ethylene glycol and the like and bulking agents and additives of common use in the explosives art.

The quantities of optional additional materials used may comprise up to 50% by weight of the total explosive composition, the actual quantities employed depending upon their nature and function.

The preferred methods for making the water-in-oil microemulsion explosive compositions of the invention comprise the steps of (a) mixing the water, inorganic oxidizer salts and, in certain cases, some of the optional water-soluble compounds, in a first premix, (b) mixing the carbonaceous fuel, emulsifying agent and any other optional oil soluble compounds, in a second premix and (c) adding the first premix to the second premix in a suitable mixing apparatus, to form a water-in-oil microemulsion. The first premix is heated until all the salts are completely dissolved and the solution may be filtered if needed in order to remove any insoluble residue. The second premix is also heated to liquefy the ingredients. Any type of apparatus capable of either low or high shear mixing can be used to prepare the microemulsion explosives of the invention. Glass microspheres, solid self-explosive ingredients such as particulate TNT, solid fuels such as aluminium or sulphur, inert materials such as barytes or sodium chloride, undissolved solid oxidizer salts and other optional materials, if employed, are added to the microemulsion and simply blended until homogeneously dispersed throughout the composition.

The water-in-oil microemulsion of the invention can also be prepared by adding the second premix liquefied fuel solution phase to the first premix hot aqueous solution phase with sufficient stirring to invert the phases. However, this method usually requires substantially more energy to obtain the desired dispersion than does the preferred reverse procedure. Alternatively, the water-in-oil microemulsion is particularly adaptable to preparation by a continuous mixing process where the two separately prepared liquid phases are pumped through a mixing device wherein they are combined and emulsified.

Characteristic of the novel explosive compositions of the invention is the unique nature of the water-in-oil microemulsion which results from the use of specific blends of emulsifiers. The microemulsion of the invention is a demonstrably different state of matter than any of previously disclosed, conventional prior art explosive emulsions. Several techniques well known to those experienced in the art, may be employed to differentiate the microemulsions of this invention from the conventional explosive emulsions of the prior art.

Microcalorimetry

The novel emulsifiers employed in the composition of this invention differ from prior art systems in that a highly ordered and stable film is produced. This stability is a consequence of the energy release on formation of the film which energy release exceeds the newly created surface energy. The microemulsions created therefore, have an energy barrier towards coalescence which barrier does not exist with prior art emulsifiers. Microcalorimetry may be used to observe the free energy change of mixing. A typical microemulsion of the present invention had a highly negative free energy change of mixing (−5 to −7 J/g of oil phase), on the other hand, a representative prior art emulsion formed from sorbitan sesqui-oleate had a much smaller free energy change of mixing closely approaching zero (−0.5 to −0.9 J/g of oil phase). This substantial energy difference helps explain the stability of the microemulsions of the present invention.

Ease of Mixing

As further evidence for ease of formation and for intrinsic stability, a microemulsion was prepared by simply pouring an aqueous oxidizer salt solution into an hydrocarbon fuel solution containing the emulsifying system of the present invention while stirring by hand with a slow spatula action. This extremely low shear mixing was sufficient to produce a stable water-in-oil microemulsion explosive composition which was subsequently aerated to a density of 1.10 g/cc, packaged in a 25 mm diameter cartridge and detonated at 5° C. with an ordinary electric blasting cap. After several weeks of storage this composition was still detonator sensitive and no visual signs of destabilization were observed.

X-Ray diffraction

All prior art explosive emulsions show gradually increasing crystal growth and structure upon storage as a consequence of their instability and slow coalescence of the aqueous oxidizer salt droplets. This increasing crystal structure can be easily detected by X-ray diffraction. The microemulsion explosives of this invention show no such X-ray diffraction pattern even at very low temperature or after prolonged storage and/or for compositions containing extremely low levels of water.

Sedimentation

To further differentiate the microemulsion explosives of this invention from prior art emulsion explosives, centrifugation experiments were conducted to observe sedimentation rates. After 30 minutes of ultracentrifugation at 35,000 G's, the microemulsions of the present invention devoid of any insoluble optional additives remained virtually intact as opposed to substantial crystallization and/or phase separation for all prior art emulsion explosives tested.

The following Examples and Tables demonstrate the unique properties of the microemulsion explosive compositions of the invention.

EXAMPLES 1–10

To demonstrate the effectiveness of the disclosed blends of polymeric and conventional emulsifiers, with and without an optional phosphatide emulsion stabilizer, in producing the desired microemulsion, a series of compositions were prepared by adding various admixtures of one polymeric emulsifier and several different conventional emulsifiers to similar formulations. The results are shown in Table I, below.

TABLE I

| | Ex. 1 | Ex. 2 | Ex. 3 | Ex. 4 | Ex. 5 |
|---|---|---|---|---|---|
| Ingredients | | | | | |
| Ammonium nitrate | 61.7 | 61.9 | 61.9 | 61.9 | 61.9 |
| Sodium nitrate | 16.6 | 16.6 | 16.6 | 16.6 | 16.6 |
| Calcium nitrate | — | — | — | — | — |
| Sodium borate | 0.5 | 0.5 | 0.5 | 0.5 | — |
| Water | 12.6 | 12.6 | 12.6 | 12.6 | 12.5 |
| Polymeric emulsifier(1) | — | 0.3 | 0.3 | 0.3 | 0.3 |
| Sorbitan sesqui-oleate | — | 1.1 | — | — | — |
| Sorbitan mono-oleate | 1.4 | — | 1.1 | — | — |
| Atmos 300 (Reg. TM)(2) | — | — | — | 1.1 | — |
| Lithium stearate | — | — | — | — | 1.0 |
| Armac HT (Reg. TM)(3) | — | — | — | — | — |
| Drewpol 10-10-0 (Reg. TM)(4) | — | — | — | — | — |
| Witcamine PA-78B (Reg. TM)(5) | — | — | — | — | — |

TABLE I-continued

| | | | | | |
|---|---|---|---|---|---|
| Witcamine 210 (Reg. TM)[6] | — | — | — | — | — |
| Lecithin | — | — | — | — | 0.7 |
| Paraffin oil | 2.9 | 2.7 | 2.7 | 2.7 | 4.5 |
| Paraffin wax | 2.0 | 2.0 | 2.0 | 2.0 | — |
| Glass microspheres | 2.3 | 2.3 | 2.3 | 2.3 | 2.5 |
| Density (g/cc) | 1.17 | 1.16 | 1.18 | 1.19 | 1.15 |
| Oxygen balance (%) | −0.1 | +0.5 | +0.5 | +0.5 | −0.7 |
| Cartridge diameter (mm) | 25 | 25 | 25 | 25 | 25 |
| Temp. (°C.) | 7 | 5 | 5 | 5 | 8 |
| Minimum initiator | EB Failed | 9 F/C (7) | 10 F/C | 9 F/C | 9 F/C |

| | Ex. 6 | Ex. 7 | Ex. 8 | Ex. 9 | Ex. 10 |
|---|---|---|---|---|---|
| Ingredients | | | | | |
| Ammonium nitrate | 61.8 | 55.7 | 61.9 | 61.9 | 61.9 |
| Sodium nitrate | 16.6 | 15.0 | 16.6 | 16.6 | 16.6 |
| Calcium nitrate | — | 5.7 | — | — | — |
| Sodium borate | — | 0.5 | — | — | — |
| Water | 12.6 | 14.1 | 12.5 | 12.5 | 12.5 |
| Polymeric emulsifier[1] | 0.3 | 0.3 | 0.3 | 0.3 | 0.3 |
| Sorbitan sesqui-oleate | — | — | — | — | 0.7 |
| Sorbitan mono-oleate | — | — | — | — | — |
| Atmos 300 (Reg. TM)[2] | — | — | — | — | — |
| Lithium stearate | — | — | — | — | — |
| Armac HT (Reg. TM)[3] | 0.7 | — | — | — | — |
| Drewpol 10-10-0 (Reg. TM)[4] | — | 0.7 | — | — | — |
| Witcamine PA-78 (Reg. TM)[5] | — | — | 0.7 | — | — |
| Witcamine 210 (Reg. TM)[6] | — | — | — | 0.7 | — |
| Lecithin | 0.7 | 0.7 | 0.7 | 0.7 | 0.7 |
| Paraffin oil | 2.8 | 2.8 | 2.8 | 2.8 | 2.8 |
| Paraffin wax | 2.0 | 2.0 | 2.0 | 2.0 | 2.0 |
| Glass microspheres | 2.5 | 2.5 | 2.5 | 2.5 | 2.5 |
| Density (g/cc) | 1.16 | 1.16 | 1.16 | 1.17 | 1.15 |
| Oxygen balance (%) | −0.6 | +0.2 | −0.6 | −0.6 | −0.6 |
| Cartridge diameter (mm) | 25 | 25 | 25 | 25 | 25 |
| Temp. (°C.) | 5 | 5 | 5 | 5 | 5 |

TABLE I-continued

| | | | | | |
|---|---|---|---|---|---|
| Minimum initiator | 9 F/C | EB[8] | 9 F/C | 9 F/C | 6 F/C |

[1]Block copolymer comprising 30% of component B (residue of water-soluble polyalkylene glycol of MW 1500)
[2]Mono and diglycerides of fat-forming fatty acids
[3]Acetic acid salts of n-alkyl amines
[4]Decaglycerol decaoleate
[5]Oil-soluble imidazoline
[6]Alkyl amidoamine
[7]Fulminate/chlorate cap
[8]Electric blasting cap (containing 0.78 g of PETN)

In Table I, the cap-sensitivity at low temperature shows the utility of these microemulsions as sensitive explosive compositions even in small diameter. Example No. 1, not containing the polymeric emulsifier, fails the cap-sensitivity test and is significantly inferior to compositions containing the polymeric emulsifier. Further, the benefits of the optional phosphatide emulsion stabilizer can be seen in Examples 5–10 inclusive. Although beneficial to the present invention, the phosphatide stabilizer is not essential as is obvious from Examples 2–4 inclusive.

EXAMPLES 11–17

A further series of compositions were prepared similar to those of Examples 1–10 but employing a number of different polymeric emulsifiers in combination with sorbitan sesquioleate. The results are shown in Table II below.

TABLE II

| | Ex. 11 | Ex. 12 | Ex. 13 | Ex. 14 | Ex. 15 | Ex. 16 | Ex. 17 |
|---|---|---|---|---|---|---|---|
| Ingredients | | | | | | | |
| Ammonium nitrate | 61.7 | 61.7 | 61.6 | 61.9 | 61.9 | 61.8 | 55.7 |
| Sodium nitrate | 16.6 | 16.6 | 16.6 | 16.6 | 16.6 | 16.6 | 15.0 |
| Calcium nitrate | — | — | — | — | — | — | 5.7 |
| Sodium borate | 0.5 | 0.5 | 0.5 | — | — | — | 0.5 |
| Water | 12.6 | 12.6 | 12.6 | 12.5 | 12.6 | 12.6 | 14.1 |
| Polymeric emulsifier - 1 | 0.4 | — | — | — | — | — | — |
| Polymeric emulsifier - 2 | — | 0.4 | — | — | — | — | — |
| Polymeric emulsifier - 3 | — | — | 0.3 | — | — | — | — |
| Polymeric emulsifier - 4 | — | — | — | 0.3 | — | — | — |
| Polymeric emulsifier - 5 | — | — | — | — | 0.2 | — | — |
| Polymeric emulsifier - 6 | — | — | — | — | — | 0.3 | — |
| Polymeric emulsifier - 7 | — | — | — | — | — | — | 0.3 |
| Sorbitan sesqui-oleate | 0.6 | 0.6 | 0.7 | 0.7 | 0.7 | 0.7 | 0.7 |
| Lecithin | 0.6 | 0.6 | 0.7 | 0.7 | 0.7 | 0.7 | 0.7 |
| Paraffin oil | 2.7 | 2.7 | 2.7 | 2.8 | 2.8 | 2.8 | 2.8 |
| Paraffin wax | 2.0 | 2.0 | 2.0 | 2.0 | 2.0 | 2.0 | 2.0 |
| Glass microspheres | 2.3 | 2.3 | 2.3 | 2.5 | 2.5 | 2.5 | 2.5 |
| Density (g/cc) | 1.10 | 1.10 | 1.10 | 1.12 | 1.16 | 1.15 | 1.15 |
| Oxygen balance (%) | 0.0 | 0.0 | −0.3 | −0.6 | −0.3 | −0.6 | +0.2 |
| Cartridge diameter (mm) | 25 | 25 | 25 | 25 | 25 | 25 | 25 |
| Temperature (°C.) | 5 | 5 | 5 | 9 | 6 | 5 | 15 |
| Minimum initiator | 7 F/C | 7 F/C | 6 F/C | 6 F/C | 7 F/C | 7 F/C | EB |

1 - Block copolymer comprising 25% of component B (residue of a polyalkylene glycol of MW 1000–1500)
2 - Block copolymer comprising 30% of component B as in 1
3 - Block copolymer comprising 35% of component B as in 1
4 - Polyester from polyisobutenyl succinic anhydride and 30% of a polyalkylene glycol of MW 600
5 - Polyester from polyisobutenyl succinic anhydride and 39% of a polyalkylene glycol of MW 600
6 - Tall oil fatty acids/trimellitic anhydride alkyd resin containing 30% of a polyalkylene glycol of MW 1500.
7 - Block copolymer comprising 20% of component B (residue of a polyethylene imine of MW 50000). The resin was formulated to be largely as an amide.

From Table II it can be seen that cap-sensitivity at low temperature was maintained with all the polymeric emulsifier combinations employed.

EXAMPLES 18–21

A further series of compositions were prepared similar to those of Examples 1–17 but employing either a blend of polymeric emulsifiers in combination with a conventional emulsifier, or a polymeric emulsifier in combination with a blend of conventional emulsifiers, or other different blends of polymeric and conventional emulsifiers, with and without an optional phosphatide emulsion stabilizer. The results are shown in Table III, below.

TABLE III

| Ingredients | Ex. 18 | Ex. 19 | Ex. 20 | Ex. 21 |
|---|---|---|---|---|
| Ammonium nitrate | 61.9 | 62.1 | 61.7 | 61.7 |
| Sodium nitrate | 16.6 | 16.6 | 16.5 | 16.6 |
| Water | 12.6 | 12.6 | 12.6 | 12.5 |
| Polymeric emulsifier - 1 | 0.2 | — | — | — |
| Polymeric emulsifier - 2 | 0.2 | — | — | — |
| Polymeric emulsifier - 3 | — | 0.2 | 0.2 | 0.2 |
| Atmos 300 (Reg. TM) - 4 | 0.5 | 0.5 | — | — |
| Sodium stearate | — | 0.5 | — | — |
| Witcamine 3164 (Reg. TM) - 5 | — | — | 0.7 | — |
| Armac HT (Reg. TM) - 6 | — | — | — | 0.7 |
| Lecithin | 0.5 | — | 0.7 | 0.7 |
| Cereclor 70 L (Reg. TM) - 7 | — | — | — | 0.5 |
| Paraffin oil | 3.0 | 3.0 | 2.8 | 2.6 |
| Paraffin wax | 2.0 | 2.0 | 2.0 | 2.0 |
| Glass microspheres | 2.5 | 2.5 | 2.8 | 2.5 |
| Density (g/cc) | 1.15 | 1.15 | 1.05 | 1.16 |
| Oxygen balance (%) | −0.6 | 0.0 | −0.4 | −0.1 |
| Cartridge diameter (mm) | 25 | 25 | 25 | 25 |
| Temperature (°C.) | 5 | 5 | 5 | 5 |
| Minimum initiator | 6 F/C | EB | 7 F/C | EB |

1 - Block copolymer comprising 30% of component B (residue of a water-soluble polyalkylene glycol of MW 1500)
2 - Polyester from polyisobutenyl succinic anhydride and 30% of a polyalkylene glycol of MW 600
3 - Polyester from polyisobutenyl succinic anhydride and 39% of a polyalkylene glycol of MW 600
4 - Mono and diglycerides of fat-forming fatty acids
5 - Alkyl amidoamine
6 - Acetic acid salts of n-alkyl amines
7 - Highly chlorinated paraffinic hydrocarbon From Table III it can be seen that cap-sensitivity at low temperature was maintained with any of the further polymeric emulsifier(s)/conventional emulsifier(s) combinations employed in these examples.

EXAMPLES 22–29

To demonstrate that a variety of oxidizer salts can be utilized in the microemulsion explosive compositions of the invention and further, to show various methods of incorporating occluded air in the composition and thus controlling the final density, a series of compositions were prepared using various oxidizer salts and density reducing methods. The results are given in Table IV, below.

TABLE IV

| Ingredients | Ex. 22 | Ex. 23 | Ex. 24 | Ex. 25 | Ex. 26 | Ex. 27 | Ex. 28 | Ex. 29 |
|---|---|---|---|---|---|---|---|---|
| Ammonium nitrate | 75.9 | 65.7 | 58.5 | 69.4 | 61.1 | 58.7 | 63.3 | 61.5 |
| Sodium nitrate | — | 17.7 | 7.0 | — | 16.5 | 7.2 | 16.9 | 16.5 |
| Calcium nitrate | — | — | 9.0 | 9.1 | — | 10.8 | — | — |
| Sodium borate | — | — | — | — | 0.5 | — | — | — |
| Water | 17.2 | 7.3 | 13.1 | 13.2 | 12.5 | 13.8 | 12.8 | 12.5 |
| Polymeric emulsifier - 1 | 0.3 | 0.3 | 0.3 | 0.3 | 0.3 | 0.3 | 0.3 | 0.3 |
| Sorbitan sesqui-oleate | 0.7 | 0.7 | 0.7 | 0.7 | 0.7 | 0.7 | 0.7 | 0.7 |
| Lecithin | 0.7 | 0.7 | 0.7 | 0.7 | 0.7 | 0.7 | 0.7 | 0.7 |
| Paraffin oil | 2.2 | 4.0 | 3.2 | 2.5 | 2.7 | 4.8 | 2.8 | 4.6 |
| Paraffin wax | 1.0 | 1.0 | — | 1.6 | 2.0 | — | 2.0 | — |
| Glass microspheres | 2.0 | 2.6 | 2.5 | 2.5 | 3.0 | 3.0 | — | — |
| Gassing solution - 2 | — | — | — | — | — | — | 0.5 | — |
| Porous glass agglomerates | — | — | — | — | — | — | — | 3.2 |
| Particulate aluminium | — | — | 5.0 | — | — | — | — | — |
| Density (g/cc) | 1.17 | 1.10 | 1.16 | 1.17 | 1.05 | 1.10 | 1.05 | 1.10 |
| Oxygen balance (%) | 0.0 | 0.0 | −0.3 | 0.0 | −0.4 | −0.4 | −0.2 | 0.0 |
| Cartridge diameter (mm) | 25 | 25 | 25 | 25 | 25 | 25 | 25 | 25 |
| Temperature (°C.) | 5 | 8 | 8 | 5 | 5 | 5 | 5 | 6 |
| Minimum initiator | 7 F/C | 6 F/C | 5 F/C | 7 F/C | 6 F/C | 6 F/C | 7 F/C | 6 F/C |
| Minimum initiator after storage at −40° C. | — | — | — | 7 F/C | Failed EB | 7 F/C | — | — |
| Minimum initiator at −40° C. | — | — | — | — | Failed EB | EB | — | — |

1 - Block copolymer comprising 30% of component B (residue of a water-soluble polyalkylene glycol of MW 1500)
2 - 50% water, 20% sodium nitrite, 30% sodium thiocyanate by weight From the results in Table IV it can be observed that a variety of oxidizer salts can be utilized in the formulation of the water-in-oil microemulsion explosives. Of particular interest is the surprising effect of calcium nitrate in producing exceptional cap-sensitivity at extremely low temperature, as exemplified in Examples 25 and 27.

Also evident from Examples 28 and 29 is the fact that porous glass agglomerates and chemical generation of in-situ gas bubbles are equally effective density reducing methods.

EXAMPLES 30–31

In order to demonstrate the exceptional stability of the microemulsion explosive compositions of this invention, a further series of compositions were prepared. The cap sensitivity of these compositions was determined within one week of manufacture and approximately every month thereafter up to about one year, at which time the supply of material was exhausted. The results are shown in Table V, the quantities shown being in weight percent.

TABLE V

| Ingredients | Ex. 30 | Ex. 31 |
|---|---|---|
| Ammonium nitrate | 61.7 | 61.7 |
| Sodium nitrate | 16.6 | 16.6 |
| Sodium borate | 0.5 | 0.5 |
| Water | 12.6 | 12.6 |
| Polymeric emulsifier - 1 | 0.4 | — |
| Polymeric emulsifier - 2 | — | 0.4 |
| Sorbitan sesqui-oleate | 0.6 | 0.6 |
| Lecithin | 0.6 | 0.6 |
| Paraffin oil | 2.7 | 2.7 |
| Paraffin wax | 2.0 | 2.0 |
| Glass microspheres | 2.3 | 2.3 |
| Density (g/cc) | 1.10 | 1.10 |
| Oxygen balance (%) | 0.0 | 0.0 |
| Cartridge diameter (mm) | 25 | 25 |
| Temperature (°C.) | 5 | 5 |
| Minimum initiator (fresh) | 7 F/C | 7 F/C |

TABLE V-continued

| Ingredients | Ex. 30 | Ex. 31 |
|---|---|---|
| Aging period (months) | 12 - 3 | 12 - 3 |

1 - Block copolymer comprising 30% of component B (residue of water-soluble polyalkylene glycol of MW 1500)
2 - Block copolymer comprising 25% of component B (residue of a water-soluble polyalkylene glycol of MW 1000–1500)
3 - Period during which cartridges were successfully detonated with electric detonator at 5° C. until the supply of the material was exhausted after 12 months A further aspect of the microemulsion explosive compotion of the present invention is that doping with substantially large proportions of, for example, energy enhancing solid materials such as solid AN prills, does not significantly alter the sensitivity or the stability of the composition. Furthermore, if the microemulsion composition is formulated so as to possess a suitably high fluidity, a very large proportion of these solid materials may be added without significant loss of pumpability. Retention of fluidity is not usually the case with water-gel explosives; the addition of extra amounts of high energy content ingredients such as AN prills is severely restricted because of rapid loss of pumpability, reduction in initiator sensitivity levels and in water resistance qualities. Doping of the microemulsion compositions of this invention at levels up to 50% addition of extra AN prills or ANFO, nevertheless produces waterproof pumpable exposive compositions which retain booster sensitivity at densities up to 1.35 g/cc. These new explosive compositions have weight strengths which are substantially higher than the weight strength of the undoped microemulsion and, more importantly, the raw material costs are at the same time substantially reduced. Furthermore, the blasting performance which is in part determined by calculable gas evolation volumes, is substantially higher than that of other pumpable, waterproof explosive compositions because of the much higher proportion of gas producing AN contained in these new explosive compositions. In addition, the other unique explosive properties associated with the microemulsion compositions such as high velocities of detonation, very small critical diameters, temperature independent sensitivity, and storage stability, are substantially retained by the doped microemulsion compositions.

Inverted phase slurries such as described in U.S. Pat. No. 4,141,767 have virtually no storage stability and are not able to support large proportions of extra added salts. On cooling to ambient temperature, some of the oxidizer salt already precipitates from the solution and this rapidly desensitizes the composition, making it less fluid and increasingly more difficult to load into boreholes by pump or to package by extrusion methods. These inverted phase compositions have limited use in that they must be pumped immediately after manufacture and detonated within a relatively limited period of time. The microemulsion compositions of the present invention, on the other hand, retain their fluidity and pumpability for long periods of time even when doped with large proportions of additional oxidizer salts.

All known prior art water-in-oil emulsion explosives also suffer from lack of stability. The presence of solid oxidizer salts act as seeding crystals and rapidly destabilizes the basic emulsion. This is illustrated in the following Examples 32–33.

EXAMPLES 32–33

A prior art emulsion based explosive composition and a microemulsion based explosive composition were prepared and then doped with ground AN to compare their sensitivity and more particularly their stability. Both compositions were submitted to a temperature cycling test consisting of 3 days of storage at 50° C. followed by 2–3 days of storage at −17° C. The results are shown in Table VI the quantities shown being in parts by weight.

TABLE VI

| Ingredients | Ex. 32 | Ex. 33 |
|---|---|---|
| Ammonium nitrate | 61.4 | 61.2 |
| Sodium nitrate | 17.0 | 16.9 |
| Water | 12.6 | 12.5 |
| Sorbitan mono-oleate | 1.0 | — |
| Sorbitan sesqui-oleate | — | 0.7 |
| Lecithin | — | 0.7 |
| Polymeric emulsifier(1) | — | 0.3 |
| Paraffin oil | 4.8 | 5.5 |
| Paraffin wax | 2.0 | 1.0 |
| Glass microspheres | 3.0 | 3.0 |
| Dopes | | |
| Ammonium nitrate - ground | 31.5 | 31.5 |
| Total (parts) | 133.3 | 133.3 |
| Properties at 5° C. in 25 mm | | |
| Oxygen balance (%) | +0.3 | −0.3 |
| Density (g/cc) | 1.17 | 1.17 |
| Minimum initiator - fresh | EB | 7 F/C |
| Minimum initiator after 1 cycle(2) | Failed 2.5 g primer | 8 F/C |
| Minimum initiator after 2 cycles | — | 9 F/C |
| Minimum initiator after 3 cycles | — | EB |

(1)Block copolymer comprising 30% of component B (residue of a water-soluble polyalkylene glycol of MW 1500)
(2)One cycle consisted of: 3 days of storage at 50° C. followed by 2–3 days of storage at −17° C. Samples were warmed up to 5° C. before testing In Table VI, it can be seen that the AN crystal doping quickly resulted in a rapid loss of initiator sensitivity of the prior art emulsion. On the other hand, the doped microemulsion was much more stable to this seeding crystal effect and remained cap-sensitive for a relatively long period of time under unusually severe storage conditions.

EXAMPLES 34–52

In order to demonstrate the various optional materials, especially oxidizer salts, which can be dispersed in the microemulsion explosive compositions of this invention to form cap-sensitive and/or booster-sensitive explosive mixtures, a series of compositions were prepared using various combinations of oxidizer salts, fuels and inert materials. The results are presented in Table VII.

TABLE VII

| Ingredients | Ex. 34 | Ex. 35 | Ex. 36 | Ex. 37 | Ex. 38 | Ex. 39 | Ex. 40 | Ex. 41 | Ex. 42 | Ex. 43 | Ex. 44 | Ex. 45 | Ex. 46 | Ex. 47 | Ex. 48 | Ex. 49 | Ex. 50 | Ex. 51 | Ex. 52 |
|---|---|---|---|---|---|---|---|---|---|---|---|---|---|---|---|---|---|---|---|
| Ammonium nitrate | 45.68 | 49.18 | 49.14 | 46.83 | 56.57 | 51.61 | 46.21 | 45.5 | 50.53 | 43.09 | 46.16 | 54.53 | 47.24 | 60.7 | 43.33 | 40.32 | 40.67 | 35.86 | 31.56 |
| Sodium nitrate | 15.36 | 13.16 | 13.25 | 12.98 | — | — | 12.37 | 12.2 | 13.52 | 11.62 | 12.35 | 6.53 | 12.67 | — | 11.68 | 13.51 | 11.27 | 11.03 | 8.74 |
| Calcium nitrate | — | — | — | — | — | 6.75 | — | — | — | — | — | 8.41 | — | — | — | — | — | — | — |
| Sodium borate | — | — | 0.36 | — | — | — | — | — | — | 0.32 | — | — | 0.37 | — | 0.32 | — | — | — | — |
| Water | 12.0 | 9.98 | 10.05 | 9.57 | 12.83 | 9.82 | 9.38 | 9.2 | 10.25 | 8.81 | 9.37 | 12.16 | 9.82 | 8.3 | 8.86 | 10.64 | 8.31 | 8.28 | 6.45 |
| Polymeric emulsifier[1] | 0.24 | 0.24 | 0.24 | 0.23 | 0.21 | 0.23 | — | 0.2 | 0.25 | 0.21 | 0.23 | 0.27 | 0.22 | 0.20 | 0.21 | 0.21 | 0.19 | 0.18 | 0.15 |
| Polymeric emulsifier[2] | — | — | — | — | — | — | 0.23 | — | — | — | — | — | — | — | — | — | — | — | — |
| Sorbitan sesqui-oleate | 0.56 | 0.56 | 0.56 | 0.52 | 0.53 | 0.52 | 0.52 | 0.5 | 0.58 | 0.49 | 0.52 | 0.63 | 0.53 | 0.6 | 0.49 | 0.84 | 0.46 | 0.41 | 0.35 |
| Lecithin | 0.56 | 0.56 | 0.56 | 0.52 | 0.53 | 0.52 | 0.52 | 0.5 | 0.58 | 0.49 | 0.52 | 0.63 | 0.53 | 0.6 | 0.49 | 0.14 | 0.46 | 0.41 | 0.35 |
| Cereclor 70 1 (Reg. TM)[4] | — | — | — | — | — | — | — | — | 0.41 | — | — | — | — | — | — | — | — | — | — |
| Paraffin oil | 2.72 | 2.72 | 2.84 | 2.10 | 3.03 | 3.71 | 4.16 | 3.9 | 2.64 | 3.93 | 2.85 | 2.34 | 3.50 | — | 3.36 | 1.89 | 2.47 | 3.86[6] | 3.25 |
| Paraffin wax | 2.0 | 1.2 | 1.6 | 1.5 | 0.75 | 0.75 | 0.75 | 1.0 | 1.24 | 1.05 | 0.75 | 1.80 | 1.50 | 3.9 | 1.40 | 1.40 | 0.65 | 1.18 | 1.15 |
| Glass microspheres | 2.0 | 2.4 | 2.0 | — | 1.87 | 2.48 | 2.25 | 2.0 | 2.47 | 1.61 | 2.25 | 2.70 | — | 1.0 | 1.26 | 1.05 | — | 1.18 | — |
| Gassing solution[3] | — | — | — | 0.75 | — | — | — | — | — | — | — | — | — | — | — | — | 0.52 | — | — |
| Dopes | | | | | | | | | | | | | | | | | | | |
| Ammonium nitrate - prills | — | — | — | — | — | — | — | 25.0 | — | — | — | — | 23.62 | 24.7 | — | — | — | 37.61 | — |
| Ammonium nitrate - ground | 18.88 | 17.0 | — | — | 23.68 | 23.61 | 23.61 | — | 17.53 | 28.38 | — | — | — | — | — | — | — | — | — |
| ANFO | — | — | — | 25.0 | — | — | — | — | — | — | — | — | — | — | — | 30.0 | 35.0 | — | 48.0[7] |
| Sodium nitrate - prills | — | — | 14.4 | — | — | — | — | — | — | — | — | — | — | — | — | — | — | — | — |
| Calcium nitrate - prills[5] | — | — | — | — | — | — | — | — | — | — | — | — | — | — | 23.6 | — | — | — | — |
| Particulate aluminium | — | 3.0 | 5.0 | — | — | — | — | — | — | — | — | — | — | — | 5.0 | — | — | — | — |
| Sodium chloride | — | — | — | — | — | — | — | — | — | — | 25.0 | — | — | — | — | — | — | — | — |
| Barium sulfate | — | — | — | — | — | — | — | — | — | — | — | 10.0 | — | — | — | — | — | — | — |
| Properties at 5° C. | | | | | | | | | | | | | | | | | | | |
| Oxygen balance (%) | +0.4 | −0.1 | −0.3 | 0.0 | −0.1 | −0.2 | −0.3 | −0.6 | +3.0 | −0.4 | −0.5 | +0.2 | −0.4 | +0.2 | −0.3 | +0.1 | −0.1 | +0.3 | −0.6 |
| Density (g/cc) | 1.15 | 1.18 | 1.21 | 1.18 | 1.20 | 1.19 | 1.20 | 1.21 | 1.12 | 1.21 | 1.26 | 1.22 | 1.25[8] | 1.27 | 1.25 | 1.29 | 1.26 | 1.25 | 1.33[8] |
| Cartrige diameter (mm) | 50 | 25 | 50 | 50 | 25 | 25 | 25 | 75 | 25 | 50 | 25 | 25 | 75 | 75 | 75 | 150 | 75 | 75 | 75 |
| Minimum initiator | 8 F/C | 7 F/C | 7 F/C | 8 F/C | 9 F/C | 7 F/C | 9 F/C | 9 F/C | 5 F/C | 9 F/C | 5 F/C | 6 F/C | — | — | — | — | — | — | — |
| Primer (g - pentolite) | — | — | — | — | — | — | — | — | — | — | — | — | 160 | 160 | 160 | 450 | 160 | 80 | 80 |
| VOD (km/sec) | 4.4 | 4.0 | 4.7 | 4.3 | 4.0 | 3.8 | 3.6 | 5.2 | 4.2 | 4.1 | 4.0 | 4.1 | 4.9 | 4.9 | 4.5 | 4.6 | 4.0 | 4.56 | 3.5 |
| Total ammonium nitrate content (%) | 64.66 | 66.18 | 49.14 | 70.44 | 80.25 | 75.22 | 69.82 | 70.5 | 68.06 | 71.47 | 46.16 | 54.53 | 70.86 | 85.4 | 43.33 | 68.64 | 73.78 | 73.47 | 78.81 |

[1]Block copolymer comprising 30% component B (residue of polyalkylene glycol of MW 1500)
[2]Polyester from polyisobutenyl succinic anhydride and 30% of a polyalkylene glycol of MW 600
[3]15 parts sodium nitrite, 20 parts ammonium nitrate, 20 parts sodium thiocyanate, 45 parts water by weight
[4]Highly chlorinated paraffinic hydrocarbon
[5]Norsk-Hydro calcium nitrate prills
[6]Fuel oil No. 2
[7]Oil-deficient ANFO - 47.25% AN and 0.75% Fuel oil No. 2
[8]Contains whipped-in air bubbles From the results in Table VII it can be seen that various combinations of oxidizer salts, fuels and/or inerts can be utilized to dope the basic microemulsion compositions and that cap-sensitivity and/or primer sensitivity is well retained even at up to fairly high levels of addition. It is equally evident that the other explosive properties such as velocity of detonation and small critical diameter, for example, are also fairly well retained by these new explosive compositions.

EXAMPLES 53–58

In order to demonstrate that various solid self-explosive ingredients and various water-soluble and/or hydrocarbonsoluble organic sensitizers may be used as sensitizing agents, in either the base microemulsion or the doped microemulsion compositions, a series of compositions were prepared using various agents representative of the above class of sensitizers. The results are shown in Table VIII.

TABLE VIII

| Ingredients | Ex. 53 | Ex. 54 | Ex. 55 | Ex. 56 | Ex. 57 | Ex. 58 |
|---|---|---|---|---|---|---|
| Ammonium nitrate | 59.1 | 60.3 | 66.3 | 38.5 | 36.2 | 37.79 |
| Sodium nitrate | 15.2 | 12.8 | — | 11.8 | 14.0 | 10.11 |
| Calcium nitrate | — | — | 8.7 | — | — | — |
| Zinc nitrate | — | 0.3 | — | 0.3 | — | — |
| Sodium borate | — | — | — | — | — | — |
| Ethylene glycol mono-nitrate | 4.6 | — | — | — | — | — |
| Ethanolamine nitrate | — | 7.2 | — | 6.6 | — | — |
| Methylamine nitrate | — | — | — | — | 9.3 | — |
| Water | 13.4 | 12.6 | 12.6 | 11.4 | 10.6 | 7.67 |
| Polymeric emulsifier[1] | 0.3 | 0.3 | 0.3 | 0.2 | 0.2 | 0.18 |
| Sorbitan sesqui-oleate | 0.7 | 0.7 | 0.7 | 0.7 | 0.6 | 0.42 |
| Lecithin | 0.7 | 0.7 | 0.7 | 0.7 | 0.6 | 0.42 |
| Paraffin oil | 2.2 | 1.6 | — | 2.3 | 2.5 | — |
| Fuel oil No. 2 | — | — | — | — | — | 1.66 |
| Paraffin wax | 1.5 | 1.5 | 2.7 | 2.0 | 1.0 | 1.19 |
| N—propyl nitrate | — | — | 6.0 | — | — | — |
| Glass microspheres | 2.3 | 2.0 | 2.0 | 0.5 | — | — |
| Dopes | | | | | | |
| Ammonium nitrate prills | — | — | — | 25.0 | 25.0 | 25.56 |
| TNT prills | — | — | — | — | — | 15.0 |
| Properties at 5° C. in 25 mm | | | | | | |
| Oxygen balance (%) | +1.4 | −0.4 | −1.9 | −3.9 | 0.0 | −8.1 |
| Density (g/cc) | 1.15 | 1.17 | 1.18 | 1.32 | 1.31[2] | 1.47 |
| Cartridge diameter (mm) | 25 | 25 | 25 | 75 | 75 | 75 |
| Minimum initiator | 5 F/C | 6 F/C | 8 F/C | — | — | — |
| Booster (g pentolite) | — | — | — | 160 | 160 | 160 |
| Velocity of detonation (km/sec) | 4.8 | 4.9 | 4.4 | 4.3 | 4.8 | 4.0 |

[1]Block copolymer comprising 30% of component B (residue of a polyalkylene glycol of MW 1500)
[2]Contains whipped-in air bubbles As can be seen from the results of Table VIII a variety of cap or booster sensitive compositions may be prepared over a broad range of densities (i.e. at various levels of occluded gas bubbles) by using various self-explosive ingredients such as TNT or water-soluble and/or hydrocarbon-soluble organic sensitizers such as ethylene glycol mononitrate, methylamine nitrate, n-propyl nitrate, ethanolamine nitrate and the like.

The versatility of the emulsifier combinations of this invention towards producing stable microemulsions in the presence of a broad range of usually hostile organic nitrate sensitizers is clearly evident in Examples 53–58. Further, this versatility provides the formulator with a most useful tool in defining a complete, tailor made range of products.

We claim:

1. A water-in-oil microemulsion explosive composition comprising an aqueous solution of one or more oxygen-supplying salts as a discontinuous phase, an insoluble liquid or liquefiable carbonaceous fuel as a continuous phase, at least one sensitizing component distributed substantially homogeneously throughout the composition as a further discontinuous phase and from 0.4 to 4.0% by weight of an emulsifying agent, characterized in that the emulsifying agent comprises a combination of at least one conventional water-in-oil emulsifier, and at least one amphiphatic graft, block or branch polymeric emulsifier.

2. A water-in-oil microemulsion explosive composition as claimed in claim 1 wherein the amphiphatic polymeric emulsifier is of the general formula $(A\text{-}COO)_2\text{-}B$ wherein each polymeric component A has a molecular weight of at least 500 and is the residue of an oil-soluble complex monocarboxylic acid and wherein each polymeric component B has a molecular weight of at least 500 and is the divalent residue of a water-soluble polyalkylene glycol.

3. A water-in-oil microemulsion explosive composition as claimed in claim 1 wherein the amphiphatic polymeric emulsifier comprises a polyester which is the product of condensation of a compound of the formula

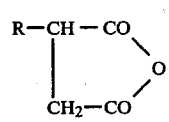

(1)

wherein R is a saturated or unsaturated hydrocarbon substituent derived from a polymer of a mono-olefin, the said polymer chain containing from 40–500 carbon atoms, and (2) a polyalkylene glycol which has a molecular weight of 500 to 20,000.

4. A water-in-oil microemulsion explosive composition as claimed in claim 2 wherein the polyalkylene glycol moiety of compound B is replaced by a polyethyleneimine chain.

5. A water-in-oil microemulsion explosive composition as claimed in claim 1 wherein the amphiphatic polymeric emulsifier comprises an alkyd resin which is the product of the condensation of (a) a polybasic acid or anhydride alone or in combination with a monobasic acid, and (b) a polyhydric alcohol which has a molecular weight of at least 500.

6. A water-in-oil microemulsion explosive composition as claimed in claim 1 wherein the conventional water-in-oil emulsifier used in combinations with the amphiphatic polymeric emulsifier is selected from the group consisting of sorbitan fatty acid esters, glycerides of fat-forming fatty acids, polyoxyethylene sorbitol esters, substituted imidazolines, aliphatic amido-amines, glycerol esters, fatty acid amines or ammonium salts, hydrocarbon sulfonate salts and alkali metal or ammonium stearates alone or in combination with stearic acid or combinations of all of these.

7. A water-in-oil microemulsion explosive composition as claimed in claim 1 wherein from 0.05% to 5.0% by weight of a phosphatide emulsion stabilizer is admixed with the polymeric emulsifier and the conventional water-in-oil emulsifier.

8. A water-in-oil microemulsion explosive composition as claimed in claim 7 wherein the phosphatide emulsion stabilizer is soybean lecithin.

9. A water-in-oil microemulsion explosive composition as claimed in claim 1 containing from 0.1% to 2.0% by weight of an emulsion promotion agent.

10. A water-in-oil microemulsion explosive composition as claimed in claim 9 wherein the said emulsion promotion agent is a highly chlorinated paraffinic hydrocarbon.

11. A water-in-oil microemulsion explosive composition as claimed in claim 1 wherein the ratio of said polymeric emulsifier to said conventional water-in-oil emulsifier is in the range of 1:25 to 3:1.

12. A water-in-oil microemulsion explosive composition as claimed in claim 7 wherein the ratio of the total mixed emulsifiers to the optional phosphatide stabilizer is in the range of 1:10 to 100:1.

13. A water-in-oil microemulsion explosive composition as claimed in claim 1 wherein the oxygen-supplying salt of the said aqueous solution comprises ammonium nitrate.

14. A water-in-oil microemulsion explosive composition as claimed in claim 13 wherein said aqueous salt solution also contains up to 40% by weight of a further oxygen-supplying salt selected from the group consisting of alkali metal and alkaline earth metal nitrates, chlorates and perchlorates or mixtures thereof.

15. A water-in-oil microemulsion explosive composition as claimed in claim 1 wherein the water content comprises 3.0% to 30.0% by weight of the total composition.

16. A water-in-oil microemulsion explosive composition as claimed in claim 1 wherein the said insoluble liquid or liquefiable carbonaceous fuel is selected from the group consisting of paraffinic, olefinic, naphthenic, aromatic, elastomeric, saturated or unsaturated hydrocarbons.

17. A water-in-oil microemulsion explosive composition as claimed in claim 16 wherein the said insoluble liquid or liquefiable carbonaceous fuel is present in an amount of from 0.1% to 20% by weight of the total composition.

18. A water-in-oil microemulsion explosive composition as claimed in claim 1 wherein the said sensitizing component distributed substantially homogeneously throughout said composition comprises gas bubbles.

19. A water-in-oil microemulsion explosive composition as claimed in claim 18 wherein the said gas bubble sensitizing component comprises up to 50% of the volume of the total composition.

20. A water-in-oil microemulsion explosive composition as claimed in claim 1 wherein the said sensitizing component distributed substantially homogeneously throughout said composition comprises a water-soluble or an hydrocarbon-soluble organic nitrate sensitizer.

21. A water-in-oil microemulsion explosive composition as claimed in claim 1 wherein the said sensitizing component distributed substantially homogeneously throughout said composition comprises a particulate solid self-explosive.

22. A water-in-oil microemulsion explosive composition as claimed in claim 20 wherein the said sensitizing component comprises up to 40% by weight of said composition.

23. A water-in-oil microemulsion explosive composition as claimed in claim 1 also containing up to 50% by weight of undissolved particulate solid oxygen-supplying salts homogeneously dispersed therein.

24. A water-in-oil microemulsion explosive composition as claimed in claim 23 wherein said undissolved particulate solid oxygen-supplying salts are selected from the group consisting of ammonium nitrate, sodium nitrate, and calcium nitrate.

25. A water-in-oil microemulsion explosive composition as claimed in claim 1 also containing up to 50% by weight of preblended ammonium nitrate/fuel oil mixture homogeneously dispersed therein.

26. A water-in-oil microemulsion explosive composition as claimed in claim 1 also containing up to 15% by weight of a particulate metal fuel selected from the group consisting of aluminum, aluminum alloys, silicon and ferro-silicon homogeneously dispersed therein.

27. A water-in-oil microemulsion explosive composition as claimed in claim 1 also containing up to 10% by weight of a particulate solid fuel homogeneously dispersed therein.

28. A water-in-oil microemulsion explosive composition as claimed in claim 1 also containing up to 40% by weight of a particulate solid inert material homogeneously dispersed therein.

29. A water-in-oil microemulsion explosive composition as claimed in claim 1 also containing a water phase or hydrocarbon phase thickening agent.

30. A water-in-oil microemulsion explosive composition as claimed in claim 29 also containing a crosslinking agent.

31. A water-in-oil microemulsion explosive composition as claimed in claim 1 also containing a liquid phase extender.

32. A water-in-oil microemulsion explosive composition as claimed in claim 1 also containing a crystal habit modifier.

33. A water-in-oil microemulsion explosive composition consisting essentially of:

(1) from 4% to 20% by weight of water;
(2) from 30% to 85% by weight of dissolved oxygen-supplying salts;
(3) from 1% to 8% by weight of an insoluble liquid or liquefiable carbonaceous fuel;
(4) from 0.5% to 1.2% by weight of an emulsifying agent comprising a combination of at least one conventional water-in-oil emulsifier and at least one synthetic polymeric emulsifier selected from amphiphatic graft, block or branch polymeric emulsifiers; and (5) a sensitizing amount of at least one sensitizing component selected from dispersed gas bubbles, water-soluble explosives, hydrocarbon-soluble explosives, and insoluble particulate explosives.

34. A water-in-oil microemulsion explosive composition as claimed in claim 33 also containing from 0.1% to 1% by weight of a phosphatide stabilizer.

35. A water-in-oil microemulsion explosive composition as claimed in claim 33 also containing up to 50% by weight of undissolved particulate oxygen-supplying salt.

36. A water-in-oil microemulsion explosive composition as claimed in claim 33 also containing up to 15% by weight of an auxiliary fuel ingredient.

37. A water-in-oil microemulsion explosive composition as claimed in claim 33 wherein the conventional water-in-oil emulsifier is selected from the group consisting of sorbitan fatty acid esters, glycerides of fat-forming fatty acids, substituted imidazolines, aliphatic amidoamines, fatty acid amines or ammonium salts and alkali metal or ammonium stearates.

38. A water-in-oil microemulsion explosive composition as claimed in claim 33 wherein the said dispersed gas bubble sensitizing component comprises:

occluded air or gas;

glass or resin microspheres;

in-situ generated gas bubbles or mixtures of these.

39. The water-in-oil microemulsion explosive composition as claimed in claim 36 wherein the said auxiliary fuel is aluminum.

40. A process for producing a microemulsion explosive composition comprising the steps of:

(1) forming an aqueous solution of at least one oxygen-supplying salt and heating said solution to above the temperature of crystallization of the said salts;

(2) forming a fuel solution of at least one liquid or liquefiable hydrocarbon fuel and an emulsifying agent and heating said solution to a temperature approximately equivalent to the temperature of said oxygen-supplying salt;

(3) blending said oxygen-supplying salt solution and said fuel/emulsifiers solution to form a water-in-oil microemulsion; and (4) incorporating into the said microemulsion a predetermined quantity of gas in an amount sufficient to cause a lowering of the density of said composition and thereby regulate its sensitivity.

41. A process for producing a microemulsion explosive composition as claimed in claim 40 wherein the quantity of gas incorporated is sufficient to provide a composition density of from 0.8 to 1.4 g/cc.

42. A process for producing a microemulsion explosive composition as claimed in claim 40 wherein the said gas incorporation is by means of direct air injection and occlusion.

43. A process for producing a microemulsion explosive composition as claimed in claim 40 wherein the said gas incorporation is by means of the addition of a gas-generating material.

44. A process for producing a microemulsion explosive composition as claimed in claim 40 wherein the said gas incorporation is by means of the addition of a void-containing material.

45. A process for producing a microemulsion explosive composition as claimed in claim 40 wherein the said fuel component and said emulsifying component are heated separately and blended with the said heated salt solution.

46. A process for producing a microemulsion explosive composition as claimed in claim 40 also comprising the step of dissolving in the said aqueous salt solution further water-soluble ingredients.

47. A process for producing a microemulsion explosive composition as claimed in claim 40 also comprising the step of dissolving in the said fuel solution further hydrocarbon-soluble ingredients.

48. A process for producing a water-in-oil microemulsion explosive composition as claimed in claim 40 comprising the further step of adding to the said microemulsion optional undissolved solid ingredients selected from particulate oxygen-supplying salts, particulate ammonium nitrate/fuel oil mixtures, particulate self-explosives, particulate metals, particulate fuels and particulate inert materials.

* * * * *